United States Patent [19]

Ludwig

[11] 4,280,251

[45] Jul. 28, 1981

[54] FEED CHIMNEY FOR A TEXTILE MACHINE SUPPLIED WITH TEXTILE FIBER TUFTS

[75] Inventor: Guy Ludwig, Mulhouse, France

[73] Assignee: Societe Alsacienne de Constructions Mecaniques de Mulhouse, France

[21] Appl. No.: 120,757

[22] Filed: Feb. 12, 1980

[30] Foreign Application Priority Data

Feb. 19, 1979 [FR] France ..... 79 04105

[51] Int. Cl.[3] ..... D01G 15/40

[52] U.S. Cl. ..... 19/105; 222/52; 406/70; 406/171

[58] Field of Search ..... 19/9, 105; 406/171, 406/70; 222/52

[56] References Cited

U.S. PATENT DOCUMENTS

| | | | |
|---|---|---|---|
| 705,374 | 7/1902 | Benefield | 406/171 |
| 3,070,847 | 1/1963 | Schwab | 19/105 X |
| 3,111,348 | 11/1963 | Binder et al. | 406/171 |
| 3,728,759 | 4/1973 | Hergeth | 19/105 |
| 3,896,523 | 7/1975 | Beukert | 19/105 |
| 3,963,111 | 6/1976 | Harrell et al. | 19/105 X |
| 3,999,687 | 12/1976 | Baer et al. | 222/52 |
| 4,009,803 | 3/1977 | Lytton et al. | 19/105 X |
| 4,030,635 | 6/1977 | Hablützel et al. | 19/105 X |
| 4,045,091 | 8/1977 | Beneke | 19/105 X |
| 4,085,977 | 4/1978 | Varga | 19/105 X |
| 4,136,911 | 1/1979 | Husges et al. | 19/105 X |
| 4,176,988 | 12/1979 | Lattmann et al. | 406/171 |
| 4,219,289 | 8/1980 | Trützschler | 19/105 X |

*Primary Examiner*—Louis Rimrodt

*Attorney, Agent, or Firm*—Holman & Stern

[57] ABSTRACT

A uniform web of fiber tufts is delivered to a textile fiber processing machine such as a carding machine by a feed chimney provided with a perforated wall. The fiber tufts are impelled into the upper portion of the chimney by means of a fan, a uniform web of fibers being discharged between rollers at the lower end of the chimney. The level of tufts within the chimney is maintained constant and under constant pressure by a regulating valve and a two-position reversing valve. The reversing valve serves to put the suction side of the fan into communication either with a tuft storage area or with the atmosphere.

4 Claims, 3 Drawing Figures

FEED CHIMNEY FOR A TEXTILE MACHINE SUPPLIED WITH TEXTILE FIBER TUFTS

This invention relates to feed chimneys for machines such as carding machines, for example, which are supplied with tufts of textile fibers from a feed duct connected to an area for fiber-tuft storage at atmospheric pressure. A chimney of this type is constituted by a casing of rectangular section, one large face of which is perforated. The upper end of the casing is connected to the outlet of a fan, the intake of which is connected to said feed duct whilst the lower end of said casing is fitted with delivery rollers for the web of fibers and adapted to be connected to the machine to be supplied such as a carding machine, for example.

In known chimneys of this type, the level of fiber tufts within the chimney as well as the air pressure prevailing in this latter are regulated by relatively complicated mechanical means. The aim of the invention is to construct a chimney of this type in which such regulating operations are performed by more simple means and specifically by means based on the principle of operation by compressed air.

To this end and in accordance with the invention, the upper portion of one wall of the casing such as the perforated wall, for example, is provided with a regulating valve which opens towards the exterior and is urged by restoring means to the closed position thereof. The aforementioned fan intake is connected to the feed duct by means of a tube in which is mounted a two-position reversing valve. In a first position, the reversing valve establishes a connection between the fan intake and the feed duct and in a second position, the valve establishes a connection between said fan intake and the surrounding atmosphere, said reversing valve being controlled by actuating means in response to the displacements of the regulating valve; in other words, the opening movement of the regulating valve causes changeover of the reversing valve to its second position whilst the closing movement of said regulating valve causes said reversing valve to return to its first position.

By virtue of this novel combination of means, the regulating valve performs a double function. In the first place, it ensures that a constant pressure is maintained within the chimney by permitting discharge of any excess pressure above a reference value corresponding to the force of the means for restoring the valve to its closed position. In the second place, said regulating valve ensures that the level of fiber tufts within the chimney is maintained at a substantially constant height by virtue of the fact that closure of the reversing valve for supplying fiber tufts to the chimney is effected as soon as the lower portion of the perforated wall of said chimney exhibits a porosity which is greatly reduced by the presence of fiber tufts up to a sufficient predetermined height. At this moment, the area of the perforated surface which still remains uncovered and consequently has a high degree of porosity is reduced to a point such that the pressure within the chimney rises to a sufficient value to cause opening of the regulating valve. A design solution of this type has the advantage of great simplicity.

In one advantageous embodiment, the upper portion of the casing wall is provided immediately above the regulating valve with a safety valve which also opens towards the exterior and is also restored to its closed position. Said safety valve continues the pressure-regulating action of the regulating valve in the event of at least partial obstruction of this latter by fiber tufts which may continue to move upwards within the chimney under the effect of inertia of the control means employed for regulating the level of fiber tufts within the chimney.

A more complete understanding of the invention will be gained from the following description and from the accompanying drawings in which one embodiment of a chimney for supplying a carding machine with tufts of textile fibers is illustrated by way of example, and in which.

Figure 1:
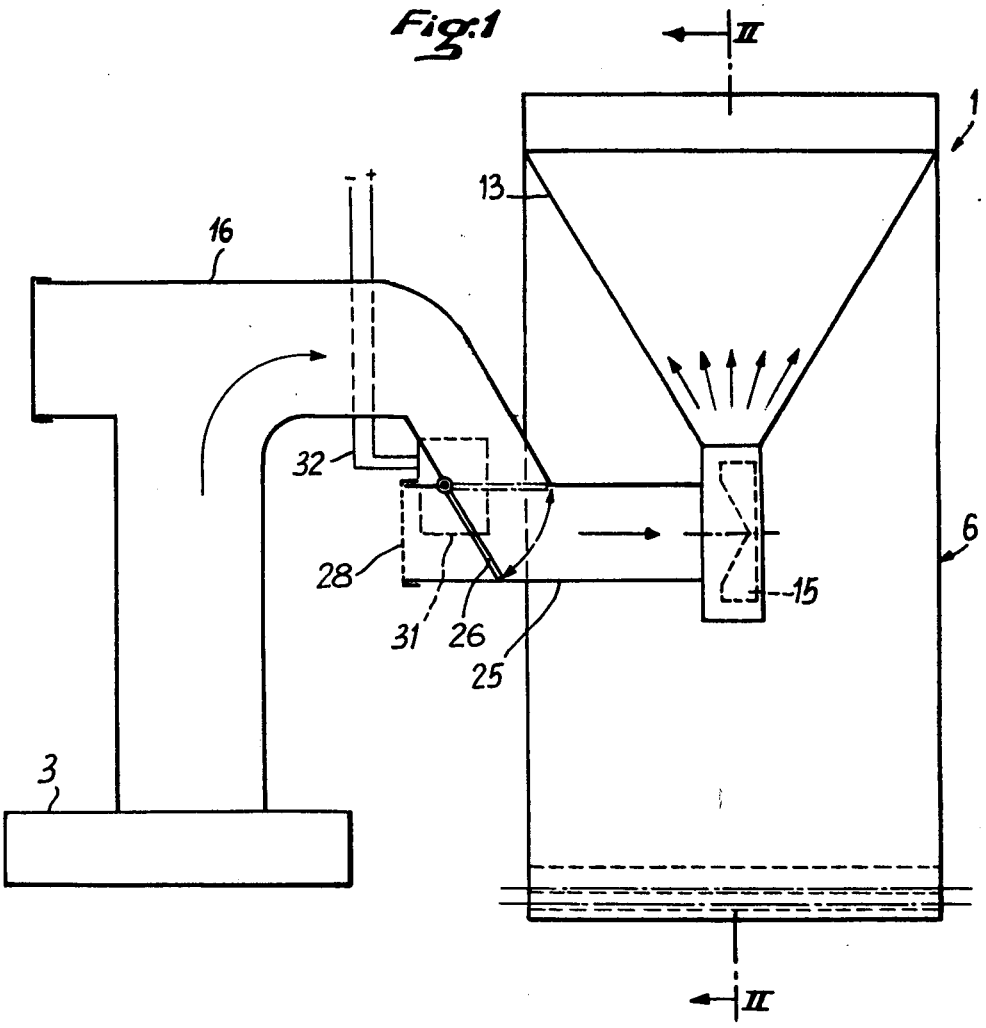
FIG. 1 is a front view of the chimney.
Figure 2:
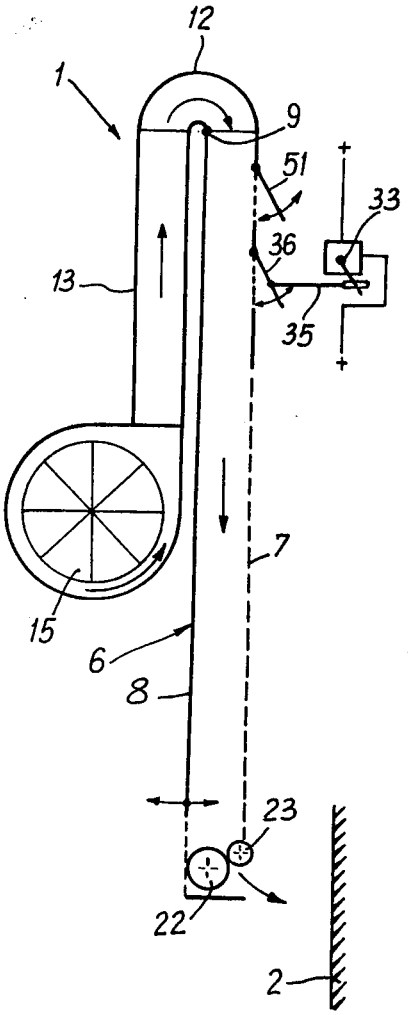
FIG. 2 is a vertical sectional view taken along line II—II of FIG. 1.
Figure 3:
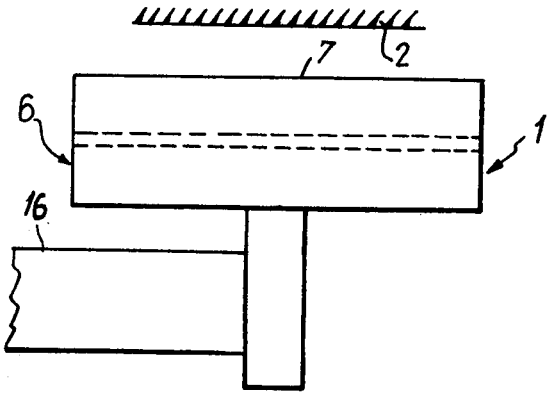
FIG. 3 is a plan view showing the main portion of FIG. 1.

The chimney which is generally designated by the reference numeral 1 in FIGS. 1 to 3 is intended to feed a machine such as a carding machine 2 for processing tufts of textile fiber and especially of cotton supplied from a storage area 3 at atmospheric pressure. The chimney is constituted by a casing 6 of rectangular cross-section, one large face of which is formed by a perforated wall 7 whilst the opposite face of said casing is formed by a solid wall 8 pivotally mounted on a horizontal hinge 9 along the top edge of said wall 8 in order to permit displacement of this latter towards or away from the perforated wall 7 according to requirements and thus to vary the horizontal cross-sectional area of the chimney 6. The top portion of the chimney is connected to the outlet of a fan 15 by means of a wide duct 12 having a 180° bend and a funnel 13, the intake of said fan being connected to a feed duct 16 which is in turn connected to the storage area 3.

The lower end of the chimney 6 is equipped with conventional rollers 22, 23 which deliver the web of fibers to the carding machine 2.

The connection between the intake of the fan 15 and the feed duct 16 is established by means of a tube 25 in which is mounted a reversing valve 26 for selectively occupying either of two end positions. In a first position shown in full lines in FIG. 1, the reversing valve establishes a connection between the fan intake and the feed duct 16 alone. In a second position shown in chain-dotted lines, said reversing valve establishes a connection between the fan intake and the surrounding atmosphere alone through a filter 28.

The reversing valve 26 is actuated by an electromechanical device 31 of any suitable and conventional type, the electric supply circuit 32 of which comprises an electric-contact system generally designated by the reference 33 and operated mechanically by a regulating valve 36 through the intermediary of means such as a dead-travel linkage 35, for example. Said regulating valve 36 is placed in the upper portion of a wall such as the perforated wall 7 of the chimney, for example, and opens towards the exterior; said valve is continuously urged to its closed position by restoring means constituted by its own weight, for example.

Immediately above the regulating valve 36, a safety valve 51 mounted on the perforated wall 7 also opens to the exterior and is also urged to its closed position by restoring means.

Operation of the installation takes place as follows:

The fan 15 draws fiber tufts up from the storage area 3 through the duct 16 and the tube 25 when the valve 26 occupies the position shown in full lines in FIG. 1. The fan then impels the tufts within the chimney 6 through the funnel 13 and the top duct bend 12 with air under a predetermined pressure; this pressure is adjusted automatically by virtue of the fact that the regulating valve 36 and the safety valve 51 open to a greater extent when the pressure within the chimney tends to become too high but move, on the contrary, to their closed positions if the pressure tends to become too low. At the same time, if the level of fiber tufts within the chimney rises, the permeability of the perforated wall 7 of the chimney decreases since the lower portion of said wall against which is fiber tufts are applied has a lower value of permeability than is the case when it is not covered with tufts, whilst the pressure within the upper portion of the chimney rises and the regulating valve 36 opens to a greater extent. Finally, when it is considered that a maximum level has been reached within the chimney, the overpressure which prevails within this latter causes the regulating valve to open until it reaches a position such as to cause operation of the reversing valve 26 in the direction of closure which prevents any further admission of fiber tufts into the fan.

Conversely, if the level of fiber tufts within the chimney falls, the permeability of the perforated wall 7 increases whereas the pressure of air within the chimney decreases. Finally, there comes a moment when the regulating valve returns to its closed position and initiates operation of the reversing valve 26 in the direction in which this latter reverts to the position shown in full lines for the admission of fiber tufts to the fan. The adoption of very simple means thus permits automatic regulation of the level of fiber tufts within the chimney as well as automatic regulation of the air pressure prevailing therein and consequently also of the rate of flow of air and of fiber tufts.

By making use of essentially pneumatic means, the invention therefore makes it possible to supply carding machines or like machines with a web of fibers having a highly uniform distribution.

The second valve 15 serves to maintain a constant value of air pressure within the chimney, especially in the event of continued admission of fiber tufts into the chimney after the first valve 36 has opened to the full extent, such an occurrence being caused by inertia of operation of the reversing valve.

It is readily apparent that, in practice, a plurality of chimneys which are identical with the chimney 1 are mounted side by side in order to feed a corresponding plurality of carding machines or the like. Each chimney is in turn supplied from a feed duct such as the duct 16 and each duct is connected to the storage area 3, the fiber tufts being thus drawn up from said storage area and supplied to the corresponding chimney.

In contrast to conventional systems, the device according to the invention has a further advantage in that it is unnecessary to provide a system for recycling fiber tufts to the storage area when they have not been drawn into the chimneys. Only that quantity of fiber tufts which is necessary for maintaining a substantially constant level within each chimney is in fact drawn into this latter.

What is claimed is:

1. A feed chimney for machines designed to process fiber tufts and especially carding machines, the fiber tufts being supplied from a feed duct connected to an area for storage of tufts at atmospheric pressure, said chimney being constituted by a casing of rectangular section having a large face formed by a perforated wall, the upper end of said casing being connected to the outlet of a fan whose intake is connected to said feed duct whilst the lower end of the casing fitted with delivery rollers for the web of fibers is adapted to be connected to a machine and in particular to a carding machine, the upper portion of one wall of the casing being provided with a regulating valve which opens towards the exterior and is urged by restoring means to the closed position thereof, wherein the fan intake is connected to the feed duct by means of a tube in which is mounted a reversing valve having two positions, namely a first position in which said reversing valve establishes a connection between the fan intake and the feed duct alone and a second position in which said valve establishes a connection between said fan intake and the surrounding atmosphere alone, said reversing valve being controlled by actuating means in response to the displacements of the regulating valve or, in other words, the opening movement of the regulating valve being such as to cause changeover of the reversing valve to its second position whilst the closing movement of said regulating valve causes said reversing valve to return to the first position thereof.

2. A chimney according to claim 1, wherein the upper portion of the casing wall is provided immediately above the regulating valve with a safety valve which also opens towards the exterior and is urged to the closed position thereof by restoring means.

3. A chimney according to claim 1 or claim 2, wherein the upper end of the large wall opposite to the large perforated wall of the casing is pivotally mounted on a horizontal axis in order to permit variation of the cross-sectional area of said chimney.

4. A chimney according to claim 1, wherein the regulating valve and safety valve are mounted on the perforated wall of said chimney.

* * * * *